US007080427B1

(12) United States Patent
Campopiano et al.

(10) Patent No.: US 7,080,427 B1
(45) Date of Patent: Jul. 25, 2006

(54) SELF-CLEANING DOOR HANDLE FOR A SELF-CLOSING DOOR

(76) Inventors: Deborah Campopiano, 176 Florida Ave., Cranston, RI (US) 02920; Richard Campopiano, 176 Florida Ave., Cranston, RI (US) 02920

( * ) Notice: Subject to any disclaimer, the term of this patent is extended or adjusted under 35 U.S.C. 154(b) by 0 days.

(21) Appl. No.: 11/304,371

(22) Filed: Dec. 15, 2005

Related U.S. Application Data

(60) Provisional application No. 60/593,750, filed on Feb. 10, 2005.

(51) Int. Cl.
*A47B 95/02* (2006.01)

(52) U.S. Cl. ..... 16/110.1; 292/347; 422/301

(58) Field of Classification Search ..... 292/336.3, 292/347, 1; 16/110.1; 422/301
See application file for complete search history.

(56) References Cited

U.S. PATENT DOCUMENTS

| | | | | |
|---|---|---|---|---|
| 1,491,780 | A | 4/1924 | Abbott | |
| 1,783,097 | A | 11/1930 | Polcari | |
| 2,044,904 | A | 6/1936 | Heisig | |
| 3,082,028 | A | 3/1963 | Werle | |
| 3,084,965 | A | 4/1963 | Carosello | |
| 3,314,746 | A | 4/1967 | Millar | |
| 4,046,508 | A | 9/1977 | McDonald | |
| 4,658,469 | A | 4/1987 | Hawkins | |
| 4,710,634 | A | 12/1987 | Brookes | |
| 4,939,812 | A | 7/1990 | Bauer | |
| 4,997,139 | A * | 3/1991 | Menard | 242/535 |
| 5,314,668 | A | 5/1994 | Biermaier | |
| 5,711,329 | A | 1/1998 | Soon | |
| 6,546,594 | B1 | 4/2003 | Wills | |
| 2004/0237255 | A1 | 12/2004 | Lin et al. | |
| 2005/0011042 | A1 | 1/2005 | Hupp et al. | |

FOREIGN PATENT DOCUMENTS

| | | |
|---|---|---|
| JP | 05033533 | 2/1993 |

* cited by examiner

*Primary Examiner*—Gary Estremsky
(74) *Attorney, Agent, or Firm*—Barlow, Josephs & Holmes, Ltd.

(57) ABSTRACT

A self-cleaning handle for a self-closing door. The door is movable by a user between a normally closed position and an open position, and is automatically moved from the open position back to the closed position. The handle having a housing secured to said door and a handle rotatably mounted in the housing. An unexposed portion of the handle is disposed within the housing and an exposed portion of the handle is exposed for grasping by a user to open the door. A cleaning wipe is disposed within the housing and is slidably engaged with the unexposed portion of said handle. The self-cleaning handle also includes a means for preventing rotation of the handle when the door is moved from the closed position to the open position, and for automatically causing rotation of the handle relative to the cleaning wipe when the door is automatically moved from the open position back to the closed position. The unexposed portion of said handle slidably wipes past the cleaning wipe to present a newly wiped exposed portion of the handle for the next user.

9 Claims, 5 Drawing Sheets

SELF-CLEANING DOOR HANDLE FOR A SELF-CLOSING DOOR

CROSS-REFERENCE TO RELATED APPLICATION

This application claims priority to earlier filed U.S. Provisional Application Ser. No. 60/593,750, filed Feb. 10, 2005, the contents of which are incorporated herein by reference.

BACKGROUND OF THE INVENTION

1. Field of the Invention

The present invention relates generally to an apparatus for automatically cleaning a surface and more particularly to an apparatus for automatically cleaning a door handle on a self-closing door.

2. Background of the Related Art

People become sick from, among other things, exposure to bacteria and viruses that they encounter in the environment. These organisms are found on just about every surface that people touch everyday. When a person touches a surface that has viruses or bacteria on it, there is a good chance that a virus or bacteria may be transferred from the surface to the person. The bacteria or viruses may then possibly enter the person's body if the person subsequently touches his or her eyes or mouth, or through some other orifice or opening in the skin, such as a cut. Moreover, the reverse may also happen, i.e. a person that is ill or carrying bacteria or viruses on his or her person may transfer the bacteria or virus to any surface or person that he or she touches. The spread of disease through direct and indirect personal contact is well documented in medical literature and in the literature of the art. Because door handles in public areas are used by a multitude of persons, the door handles become the unwitting agents of the spread of diseases. Therefore, there is a need for a device to clean a door handle to prevent the spread of disease among people who use the door.

In addition to the known medical causes of the spread of diseases, some people have a phobia of contracting such diseases from door handles. People that have this condition encounter difficulty in daily living by having to wait for others to operate the door for them or resort to carrying home-made tools with them that enable them to open doors without touching them, or having a multitude of disposable tissues or latex gloves on hand at all times. Waiting for others to operate a door suffers the obvious disadvantage that nobody else may be around to operate a particular door that the person needs to gain access through. Tools suffer the disadvantage in that there are many different types of doors. A person would have to carry a different type of tool for each kind of door. Latex gloves and tissues are slightly more practicable, but they suffer from the disadvantage that the person must carry a constant supply that becomes exhausted throughout the day. Therefore, there is a need for a self cleaning door handle that obviates the need for a person to have a separate tool, disposable tissue or glove, or help from another person.

One device that attempts to solve these problems is disclosed in U.S. Pat. No. 4,046,508, issued to McDonald. The McDonald patent discloses a self-cleaning door handle apparatus that is intended to be mechanically operated when the door is opened. As can be seen in the figures and described in the specification, it is intended that a rod is to be pushed by the opening of the door, which causes a pawl to engage a gear to turn a wheel, which functions as the door handle. As the wheel turns, it passes through a wipe that applies a sterile solution to the wheel from a reservoir. The apparatus also has a squeegee to dry the surface of the wheel. A critical flaw in this invention, however, is the fact that the wheel turns as the user operates the door. This is precisely when the device should not operate because the user is grasping the wheel. Moreover, the inherent design of using the push rod will not function as anticipated and makes the device prone to jamming. In particular, the travel distance between the door and the doorjamb is insufficient to push the rod a sufficient distance to drive the wheel. Therefore, there is a need of a self-cleaning door handle device that does not operate while the user is grasping he handle and a self-cleaning door handle device that functions properly and is less prone to jamming.

SUMMARY OF THE INVENTION

The present invention solves the problem presented in the prior art by providing a novel apparatus that cleans the handle of a self-closing door by rotating the handle through a disinfecting solution only as the self-closing door closes. More particularly, the self-cleaning handle for a self-closing door of the present invention. The door is movable by a user between a normally closed position and an open position, and is automatically moved from the open position back to the closed position. The handle having a housing secured to the door and a handle rotatably mounted in the housing. An unexposed portion of the handle is disposed within the housing and an exposed portion of the handle is exposed for grasping by a user to open the door. A cleaning wipe is disposed within the housing and is slidably engaged with the unexposed portion of said handle. The self-cleaning handle also includes a means for preventing rotation of the handle when the door is moved from the closed position to the open position, and for automatically causing rotation of the handle relative to the cleaning wipe when the door is automatically moved from the open position back to the closed position. The unexposed portion of said handle slidably wipes past the cleaning wipe to present a newly wiped exposed portion of the handle for the next user.

Accordingly, among the objects of the present invention is the provision for a self-cleaning door handle device that only cleans the door handle while the door is closing.

Another object of the present invention is the provision for a self-cleaning door handle device that consistently operates without jamming.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
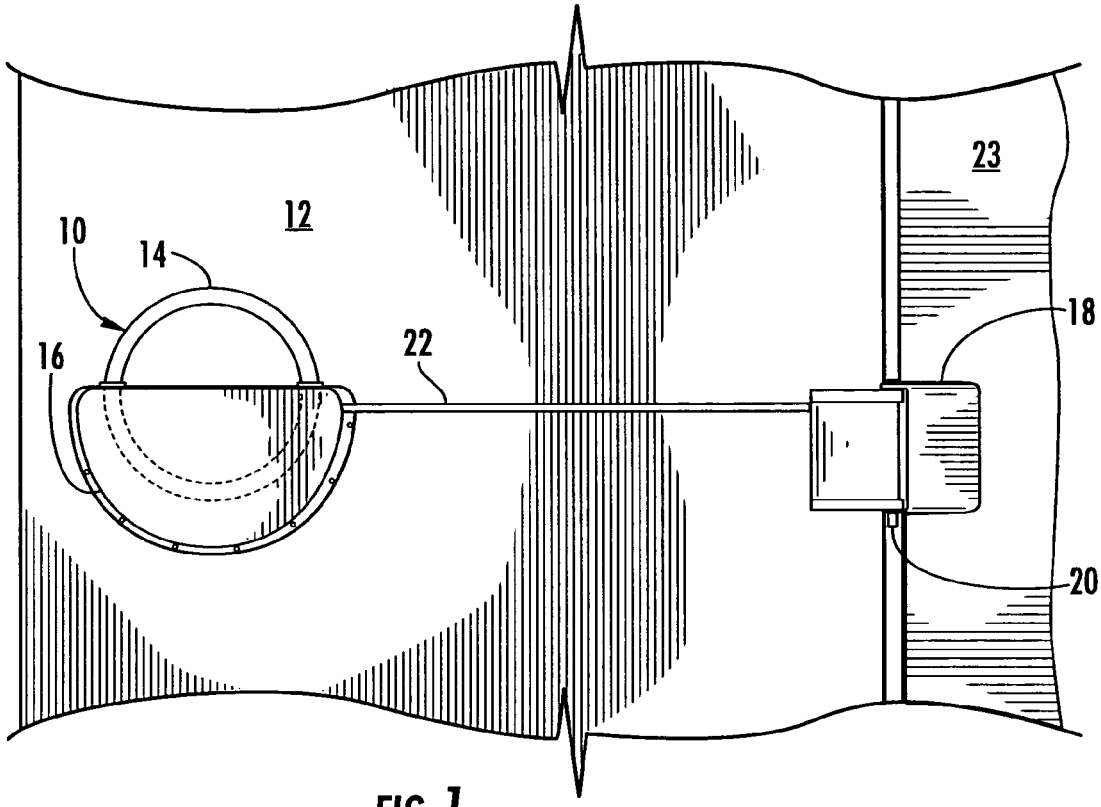
FIG. 1 is a front view of the preferred embodiment of the present invention.

Referring now to FIG. 1, the preferred embodiment of the self-cleaning door handle of the present invention is shown 10 attached to a typical self-closing door 12. As will be more fully described below, the self-cleaning door handle 10 of the present invention has a ring-shaped handle 14 rotatably mounted within a housing 36 that is secured to the self-closing door 12. A gearbox 18, attached at a hinge 20 of the self-closing door 12 drives a cable 22, which subsequently turns the handle 14 as the door 12 closes. The mechanism used to close the self-closing door 12 is used to power the self-cleaning door handle 10 of the present invention. These self-closing door mechanisms are well-known in the art and the particular system used is unimportant to the present invention. The door 10 is mounted to a doorjamb 23 of a door frame by the hinge 20.

Figure 5:
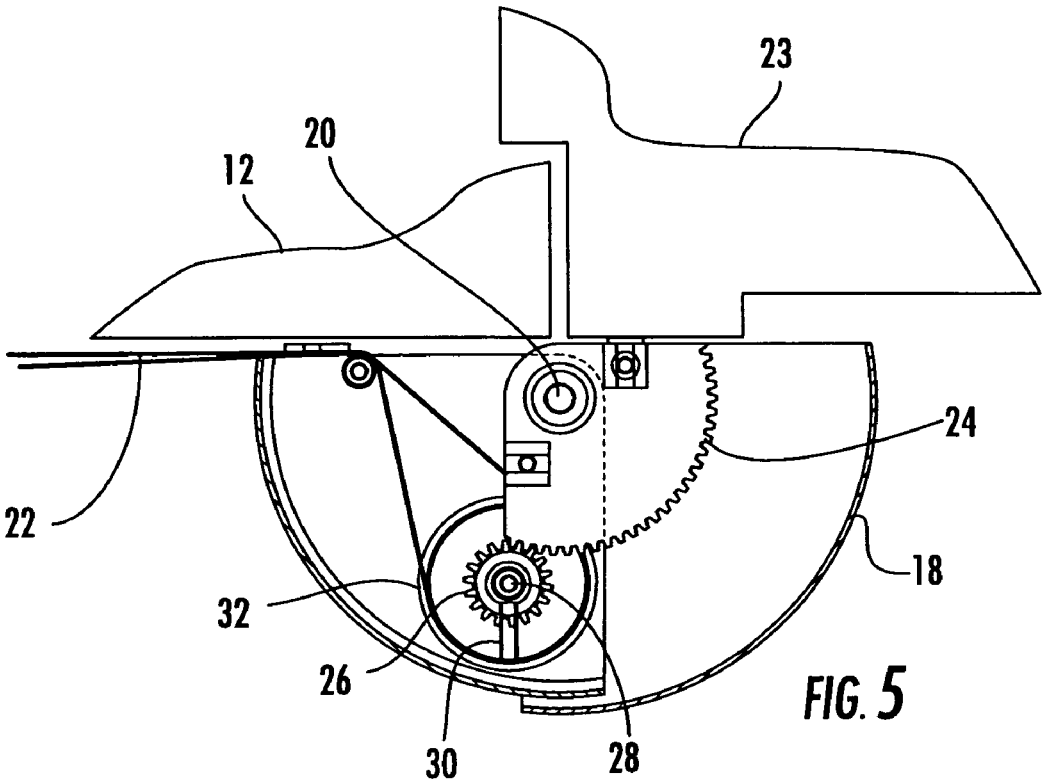
FIG. 5 is a cross-section top view of the gearbox of the present invention while the door is closed.
Figure 6:
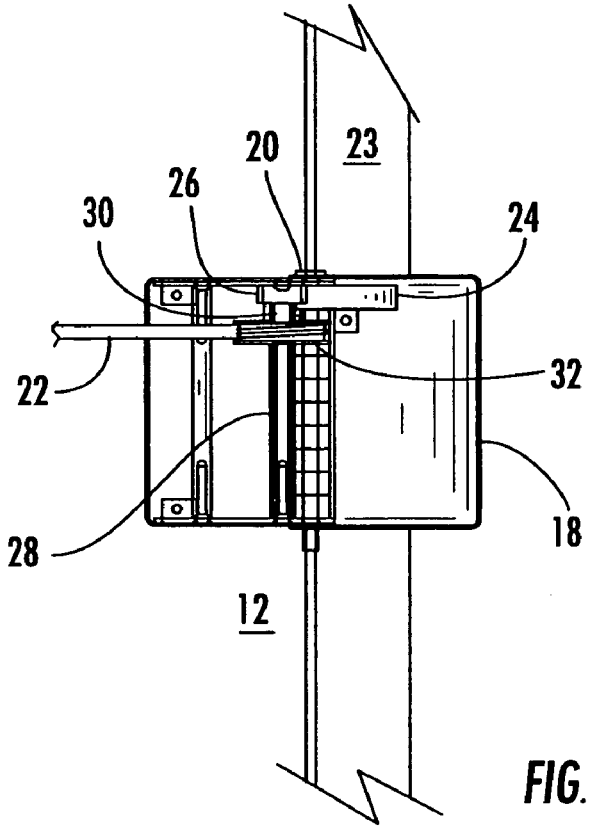
FIG. 6 is a cross-section front view of the gearbox of the present invention while the door is closed.
Figure 7:
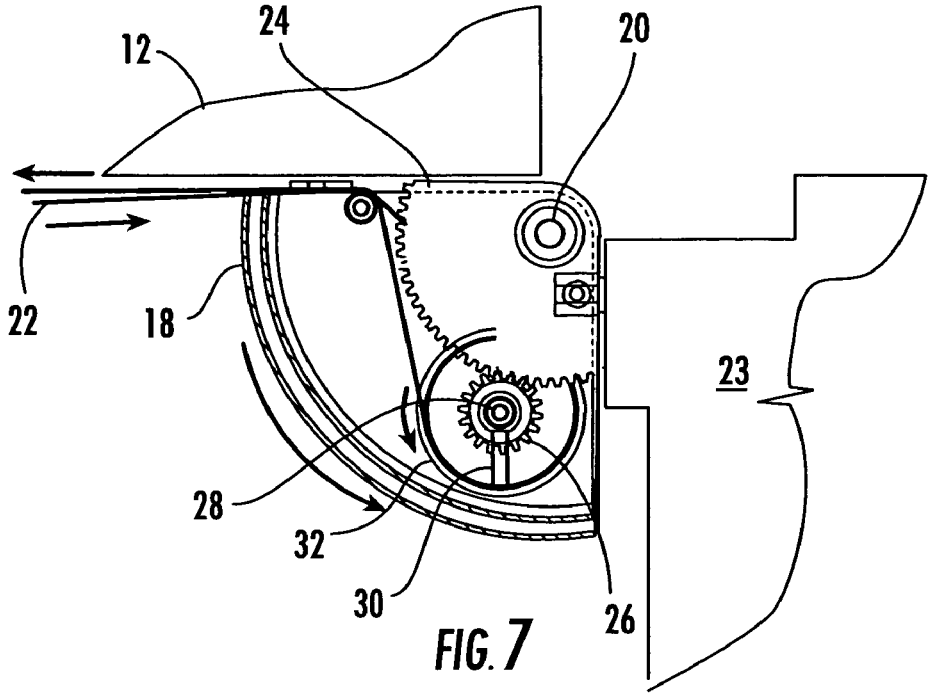
FIG. 7 is a cross-section top view of the gearbox of the present invention while the door is open.
Figure 8:
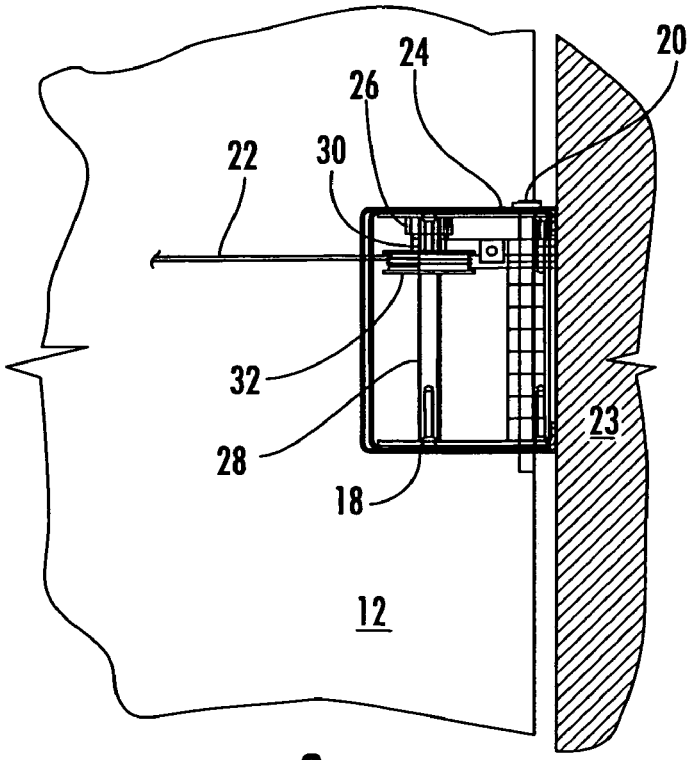
FIG. 8 is a cross-section front view of the gearbox of the present invention while the door is open.

Referring to FIG. 5, attached to the hinge 20 is a gearbox 18 having a fixed drive gear 24 disposed therein. The drive gear 24 turns a pinion 26 as the door 12 is opened or closed as shown in FIGS. 5 and 7. The pinion is mounted to shaft 28, which is rotatably held by a bracket 30, which is best seen in FIG. 6. Also attached to the pinion is a first pulley 32. The first pulley 32 rotates with the pinion 26 as the door 12 is opened and closed. The first pulley 32 drives the cable 22.

Figure 2:
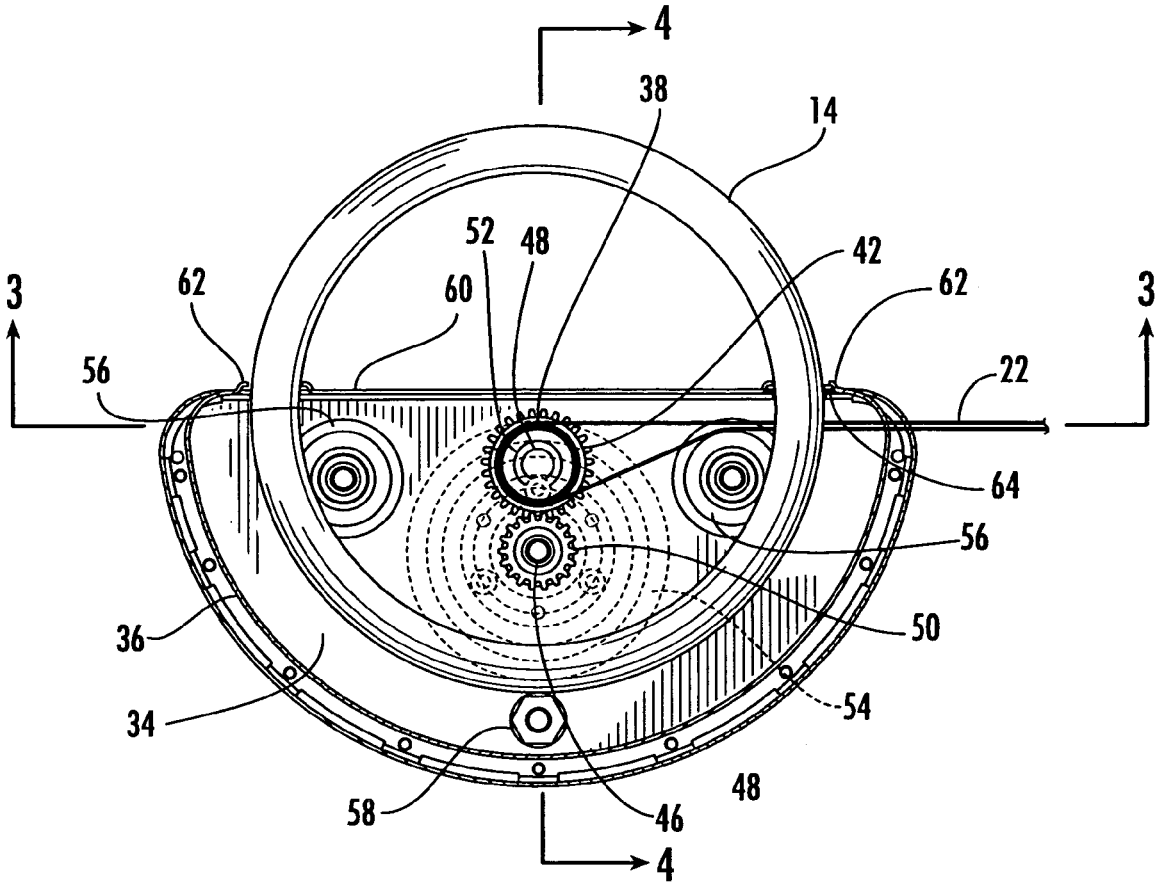
FIG. 2 is a partial cross-section front view of the preferred embodiment of the present invention.

Referring now to FIG. 2, the self-cleaning door handle 10 of the present invention also includes a base plate 34, which is mounted to the door 12 in roughly the area where a door knob would be typically located on the door 12. The base plate 34 includes a housing 36 that encloses the base plate 34 and other internal components of the self-cleaning door handle 10 of the present invention. These components and the housing 36 itself will be more fully described below.

Rotatably mounted to the base plate 34 is a second pulley 38. The cable 22 enters a slot 40 through the housing 36 and is configured to drive the second pulley 38. The second pulley 38 drives a sleeve 48. The sleeve 48 is connected to a second gear 42 having a clutch 52. The clutch 52 is configured to engage the sleeve 48 in only one rotational direction, and to turn freely in the other direction, thereby allowing the second gear 42 to rotate as the second pulley 38 rotates only as the door 12 closes.

It is important to note that during installation of the self-cleaning door handle 10 of the present invention, the second gear 42 can be reversed thereby enabling the self-cleaning door-handle 10 to function for both left-hand opening doors and right-hand opening doors 12 as desired. In this configuration, the slot 40 on the housing 36 is formed on the opposite side of the housing 36. The slot 40 is preferably formed on the housing36 as a break-away tab (not shown) that can easily be dislodged with a screwdriver or other tool. Two break-away tabs are formed at each end of the housing 36. During installation, the installer breaks away the break-away tab on the desired side of the housing 36 depending on whether the self-closing door handle will be mounted on a left-hand opening door or right-hand opening door 12.

Figure 3:
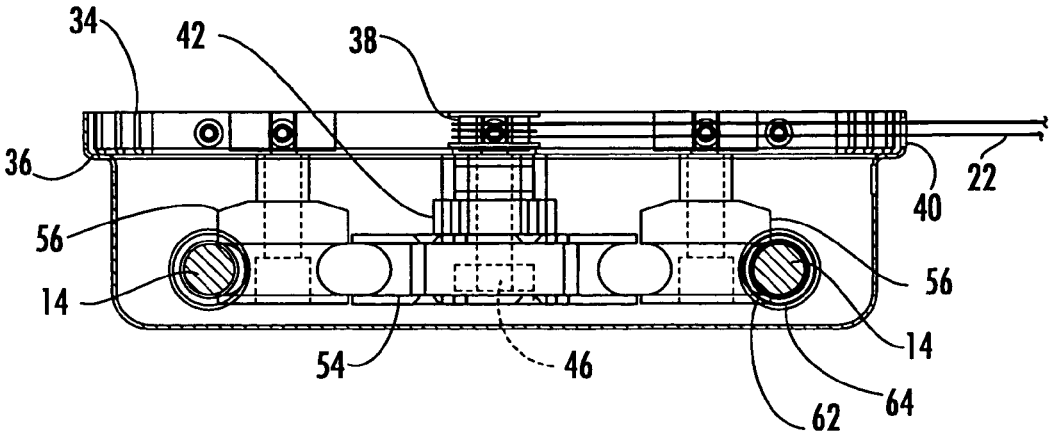
FIG. 3 is a partial cross-section view through line 3—3 of FIG. 2.
Figure 4:
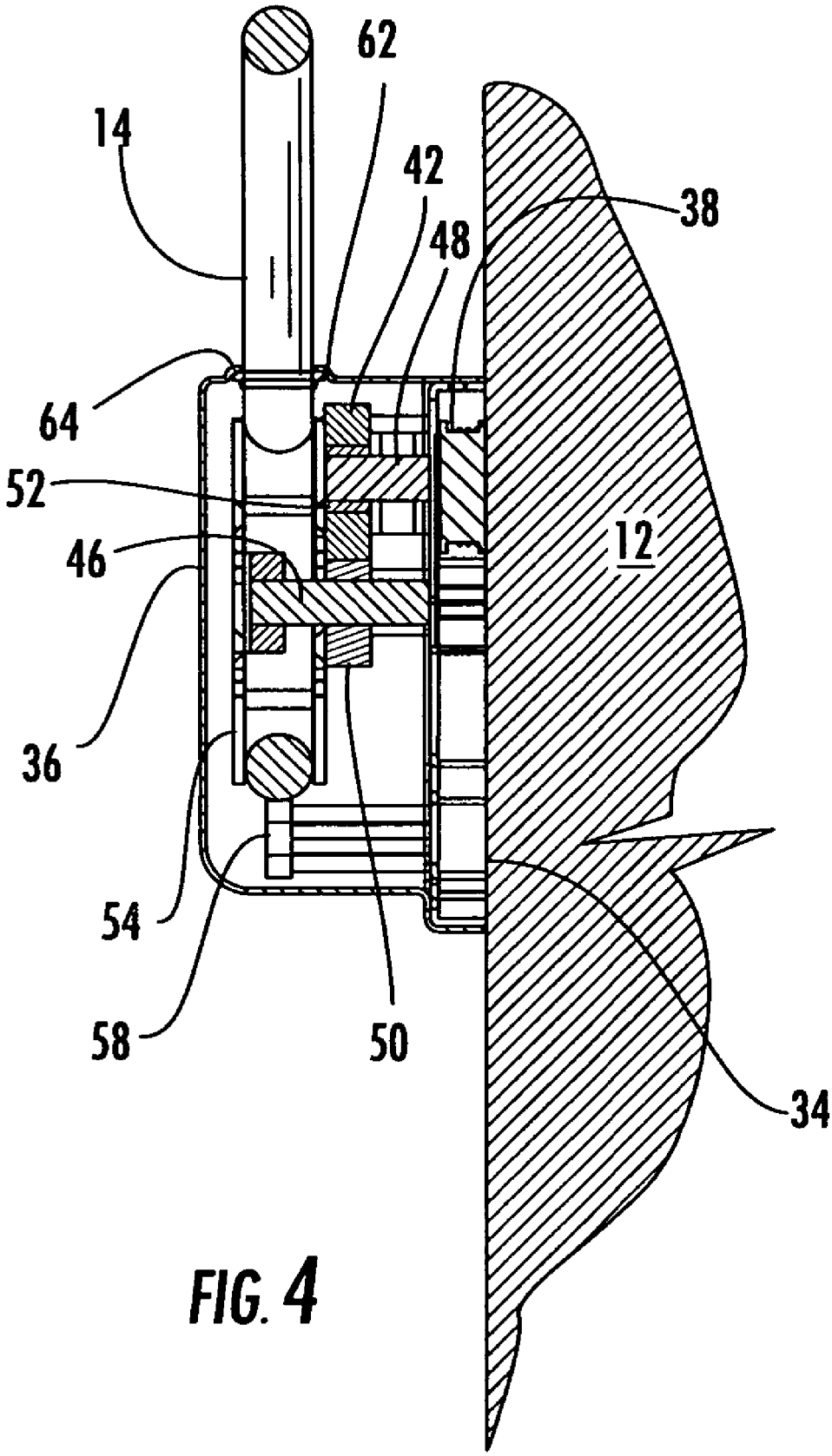
FIG. 4 is a partial cross-section view through line 4—4 for FIG. 2.

The second gear 42 is preferably a two-inch gear, but other size gears could be used to accomplish the same result with equal effectiveness. The second gear 42 drives a first gear 50 that will be described more fully below. These components can also be seen in FIGS. 3–4.

Extending from the base plate 34 is a bolt 46 that doubles as an axle. Rotatably mounted to the bolt 46 is the first gear 50. Connected to the first gear 50, is a drive wheel 54. As the first gear 50 is driven by the second gear 42, the first gear 50 drives the drive wheel 54. The drive wheel 54 is configured and arranged to drive the handle 14. The first gear 50 is preferably a one inch gear, but other size gears could be used to accomplish the same result with equal effectiveness.

The handle 14 is a circular or ring-shaped loop that is rotatably mounted in place by a pair of guide rollers 56 and an idler bearing 58. The guide rollers 56 and idler bearing 58 are each rotatably mounted to the base plate 34 and serve as a track for the handle 14 to rotate within.

The housing 36 encloses the sides and bottom of the base plate 34, drive wheel 54, clutch 52, bolt 46, guide rollers 56, idler bearing 58, first gear 50, second gear 42, sleeve 48, and second pulley 38 to protect these components and present a more aesthetic appearance. The housing 36 also forms a reservoir for a disinfectant to be contained therein. The disinfectant can be any known antiseptic solution that is well-known in the art. Optionally, the disinfectant could be included in a disposable cartridge (not shown) that may be inserted in the housing 36 and removed as needed to facilitate maintenance and upkeep of the self-cleaning door handle 10 of the present invention.

The housing 36 also has a top cover 60 to enclose the top of the self-cleaning door handle apparatus 10. The top cover 60 has a pair slots 62 formed thereon to allow the handle 14 to freely rotate through the top cover 60, presenting an exposed portion for the user to grasp to open the door. Mounted in one of the slots 62 is a wipe 64. The wipe 64 frictionally cleans and dries the unexposed surface of the handle 14 as it rotates into the disinfectant and through the slot 62 the top cover 60.

The gear ratios of the pinion 26, drive gear 24, first pulley 32, second pulley 38, first gear 50, second gear 42, sleeve 48, and drive wheel 54 are arranged such that the handle will be rotated about 180 degrees as the door 12 closes. The process of selecting these gear ratios is very well-known in the art. The important concept of the present invention is to harness the kinetic energy of the self-closing door 12 to drive a device to clean the door handle as the self-closing door 12 closes. Additionally, the handle 14 need not be circular. For instance, it could be a rod instead.

Therefore, it can be seen that the present invention provides a unique solution to the problems of providing a self-cleaning door handle apparatus for a self-closing door that cleans the handle as the door is closing and is less prone to malfunction than the McDonald apparatus.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A self-cleaning handle mounted to a self-closing door, said door being movable by a user between a normally closed position and an open position, and being automatically moved from said open position back to said closed position, said handle comprising:

a housing secured to said door, a handle rotatably mounted in said housing, wherein an unexposed portion of said handle is disposed within said housing and an exposed portion of said handle is exposed for grasping by a user to open said door, a cleaning wipe disposed within the housing, said cleaning wipe being slidably engaged with said unexposed portion of said handle, means for preventing rotation of said handle when said door is moved from said closed position to said open position, and for automatically causing rotation of said handle relative to said cleaning wipe to when said door is automatically moved from said open position back to said closed position, said unexposed portion of said handle slidably wiping past said cleaning wipe to present a newly wiped exposed portion of said handle for the next user.

2. The apparatus of claim 1, wherein the handle is ring-shaped.

3. The apparatus of claim 1, wherein the housing is configured and arranged to form a reservoir to hold a disinfectant solution.

4. The apparatus of claim 1, wherein the handle rotates substantially 180 degrees.

5. The apparatus of claim 1, wherein the means for preventing rotation and for automatically causing rotation of said handle, comprises:

a gearbox configured and arranged to drive a cable, said gearbox being mounted to a hinge of said door, said cable being configured and arranged to drive a clutch, said clutch configured and arranged to drive a drive wheel, said drive wheel configured and arranged to drive the handle, said clutch configured to prevent the drive wheel from rotating said handle when said door is moved from said closed position to said open position, and allow the drive wheel to rotate the handle when said door is automatically moved from said open position back to said closed position.

6. A self-cleaning handle mounted to a self-closing door, said door being movable by a user between a normally closed position and an open position, and being automatically moved from said open position back to said closed position, said handle comprising:

a housing secured to said door, a handle rotatably mounted in said housing, wherein an unexposed portion of said handle is disposed within said housing and an exposed portion of said handle is exposed for grasping by a user to open said door, a cleaning wipe disposed within the housing, said cleaning wipe being slidably engaged with said unexposed portion of said handle, a gearbox configured and arranged to drive a cable, said gearbox being mounted to a hinge of said door, said cable being configured and arranged to drive a clutch, said clutch configured and arranged to drive a drive wheel, said drive wheel configured and arranged to drive the handle, said clutch configured to prevent the drive wheel from rotating said handle when said door is moved from said closed position to said open position, and allow the drive wheel to rotate the handle when said door is automatically moved from said open position back to said closed position, and said unexposed portion of said handle slidably wiping past said cleaning wipe to present a newly wiped exposed portion of said handle for the next user.

7. The apparatus of claim 6, wherein the handle is ring-shaped.

8. The apparatus of claim 6, wherein the housing is configured and arranged to form a reservoir to hold a disinfectant solution.

9. The apparatus of claim 6, wherein the handle rotates substantially 180 degrees.

* * * * *